US005230655A

United States Patent [19]

Thompson et al.

[11] Patent Number: 5,230,655

[45] Date of Patent: Jul. 27, 1993

[54] LOUVER ASSEMBLY FOR A ROOM AIR CONDITIONER

[75] Inventors: Christopher M. Thompson, Nashville; Brian J. Phillips, Rutherford County, both of Tenn.

[73] Assignee: Whirlpool Corporation, Benton Harbor, Mich.

[21] Appl. No.: 811,574

[22] Filed: Dec. 20, 1991

[51] Int. Cl.[5] ..... F24F 13/15

[52] U.S. Cl. ..... 454/202; 454/315; 454/318; 454/319

[58] Field of Search ..... 454/155, 201, 202, 313, 454/314, 315, 318, 319, 320, 321

[56] References Cited

U.S. PATENT DOCUMENTS

| | | | |
|---|---|---|---|
| 2,735,351 | 2/1956 | Abrahamsen . | |
| 2,737,788 | 3/1956 | Buttner . | |
| 2,920,549 | 1/1960 | Freitag et al. | 454/314 |
| 2,940,376 | 6/1960 | Lambert . | |
| 3,035,504 | 5/1962 | Cline et al. | 454/315 |
| 3,177,797 | 4/1965 | Kennedy . | |
| 3,257,931 | 6/1966 | Lupton . | |
| 3,306,182 | 2/1957 | Schwartz . | |
| 3,320,871 | 5/1967 | Wegman . | |
| 3,472,149 | 10/1969 | Harrison . | |
| 3,509,613 | 5/1970 | Koenig . | |
| 3,636,854 | 1/1972 | Cary | 454/314 |
| 3,641,913 | 2/1972 | Dennis . | |
| 3,685,427 | 8/1972 | Loyd . | |
| 3,699,873 | 10/1972 | Kirvin . | |
| 3,713,376 | 1/1973 | Ring . | |
| 4,345,510 | 8/1982 | Sterett . | |
| 4,492,094 | 1/1985 | Katayama . | |
| 4,621,570 | 11/1986 | Belton et al. . | |
| 4,633,770 | 1/1987 | Taylor et al. . | |
| 4,702,156 | 10/1987 | Sano . | |
| 4,750,410 | 6/1988 | Parker . | |
| 4,777,870 | 10/1988 | Bolton et al. . | |
| 5,046,406 | 9/1991 | Harris et al. | 454/202 |

*Primary Examiner*—Harold Joyce

*Attorney, Agent, or Firm*—Hill, Steadman & Simpson

[57] ABSTRACT

A plurality of adjustable louver assemblies are provided for a room air conditioner. Each louver assembly has a box-like housing which receives a plurality of horizontal and vertical louvers. Each set of horizontal and vertical louvers are linked so as to move in tandem An actuator wheel is rotatably attached to the housing and is engaged with one of the louvers of the upstream set of louvers such that rotation of the actuator will result in pivoting of the louvers. At least one of the sets of louvers is completely pivotable to a closed position so as to eject air more forcefully from the remaining open louver assemblies of the air conditioner.

11 Claims, 3 Drawing Sheets

LOUVER ASSEMBLY FOR A ROOM AIR CONDITIONER

BACKGROUND OF THE INVENTION

The invention is directed to a room air conditioner and more particularly to a room air conditioner having an adjustable, louver air discharge assembly.

Room air conditioners generally have an air inlet and an air outlet at a front side of the air conditioner which faces the interior of the room when the air conditioner is positioned in a window opening or in a through-the-wall sleeve. Usually warm air is drawn in through a central portion of the front panel to pass through a filter and through the evaporator coil to be cooled and then is directed by a blower or fan to an outlet or outlets, also in the front panel. The outlet may be a single opening positioned either along a top or bottom edge of the front panel or may be a single opening positioned at one side or the other of the front panel. Occasionally the air from the blower is directed into a manifold type box or plenum chamber and from that chamber it is allowed to exit through the front of the air conditioner through more than one opening. For example in U.S. Pat. No. 3,472,149, assigned to the assignee of the present invention, air is drawn into the air conditioner unit through a lower front grill portion and is redelivered to the room through a grill portion which extends along the top edge of th air conditioner.

In U.S. Pat. No. 2,737,788, air is drawn in from a front lower grill opening, through a filter and the air is pressurized by a fan mounted in a manifold chamber or plenum from which air is permitted to exit through two spaced grills In U.S. Pat. No. 4,492,094 air is drawn in through a front grill, is pressurized by a fan and exits through a grill 30 located at a bottom edge of the front panel. FIGS. 1 and 2 of that patent illustrate prior art constructions of top and side return of cooled air to the room.

The use of a manifold plenum chamber or similar structure requires an extra space in the air conditioner thereby reducing the compactness of the air conditioner and adding to bulkiness. Also such a structure requires extra parts and weight, thus increasing the costs and complexity of manufacturing. Oftentimes, particularly when the air outlet is positioned on a single side of the air conditioner, the air is drawn into the air conditioner evaporator coil in an off-center fashion thereby reducing the efficiency of the air conditioner.

Air outlet openings are occasionally provided with directional controls which may be in the form of louvered members. U.S. Pat. No. 3,713,376 discloses the use of a plurality of horizontally louvered discharge members which are mountable into and removable from an air conditioner and which pivot about a vertical axis to provide a range of directional air flows. The individual horizontal louvers, however, are stationary within the members.

U.S. Pat. No. 3,257,931 discloses a louvered air outlet assembly wherein the louvers are pivotable about both a horizontal and vertical axis. The louvers are also powered such that they will continuously rotate during operation so that the chilled air will be directed in a sweep pattern horizontally and vertically.

SUMMARY OF THE INVENTION

It is an object of the present invention to provide an air conditioner that has one or more air outlets at which directional control is available.

It is a further object to provide a room air conditioner outlet that directs exiting air in both a horizontal and vertical sense.

It is a further object to provide a room air conditioner wherein the horizontal and vertical directing of the exiting air can be selectively changed between a plurality of angles.

It is a further object of the invention to provide a room air conditioner adjustable louver assembly that is modular in format and can be quickly and easily attached to and removed from the air conditioner unit.

It is a further object of the invention to provide a room air conditioner adjustable louver assembly that can be assembled without the use of fasteners.

It is a further object of the invention to provide an air conditioner with two or more air discharge louver assemblies wherein each of the air discharge assemblies can be individually controlled, adjusted and even closed so that air flow from the air conditioner into the room can be adjusted through a wide range of possibilities.

These and other objects are accomplished by providing a room air conditioner that has separate adjustable louver assemblies in the form of modular box-like units provided at each front panel opening of the air conditioner so that the user can select the desired flow path for the exiting air.

The modular box-like units have pins at a top and bottom end which snap into mounts in the air conditioner. The units contain both vertical and horizontal sets of louvers. The horizontal louvers are each pivotable about an individual horizontal axis and the vertical louvers are each pivotable about an individual vertical axis such that the air passing through the units can be directed through both a vertical and horizontal angular range. At least one of the sets of louvers can be pivoted to a fully closed position such that the adjacent louvers lay on top of one another to substantially completely close the air flow path through that particular louver assembly. By closing one or the other assembly, a greater volume of air is caused to flow out through the remaining open assembly, thus causing the cooled air to be ejected farther into the room to be cooled. The modular box-like units are constructed of individual pieces including a box-like housing member, a plurality of horizontal louver members, a plurality of vertical louver members connecting links for each set of louver members and an actuator member for the horizontal louver members. The pieces are constructed so as to snap together into an interengaged assembly without the use of additional fasteners.

The horizontal louvers are each pivotable about their own pivot pin. The horizontal louvers are all connected together by a connector link so as to move in tandem. Also, an actuator is provided which is exposed at a front side of the housing for operation by manual manipulation of the activator.

The vertical louvers are each pivotable about their own pivot pin. The vertical louvers are all connected together so as to move in tandem. The vertical louvers are exposed at a front side of the housing and at least one of the louvers is provided with a manipulator projection to assist in manual pivoting of the vertical louvers.

DETAILED DESCRIPTION OF THE PREFERRED EMBODIMENT

Figure 1:
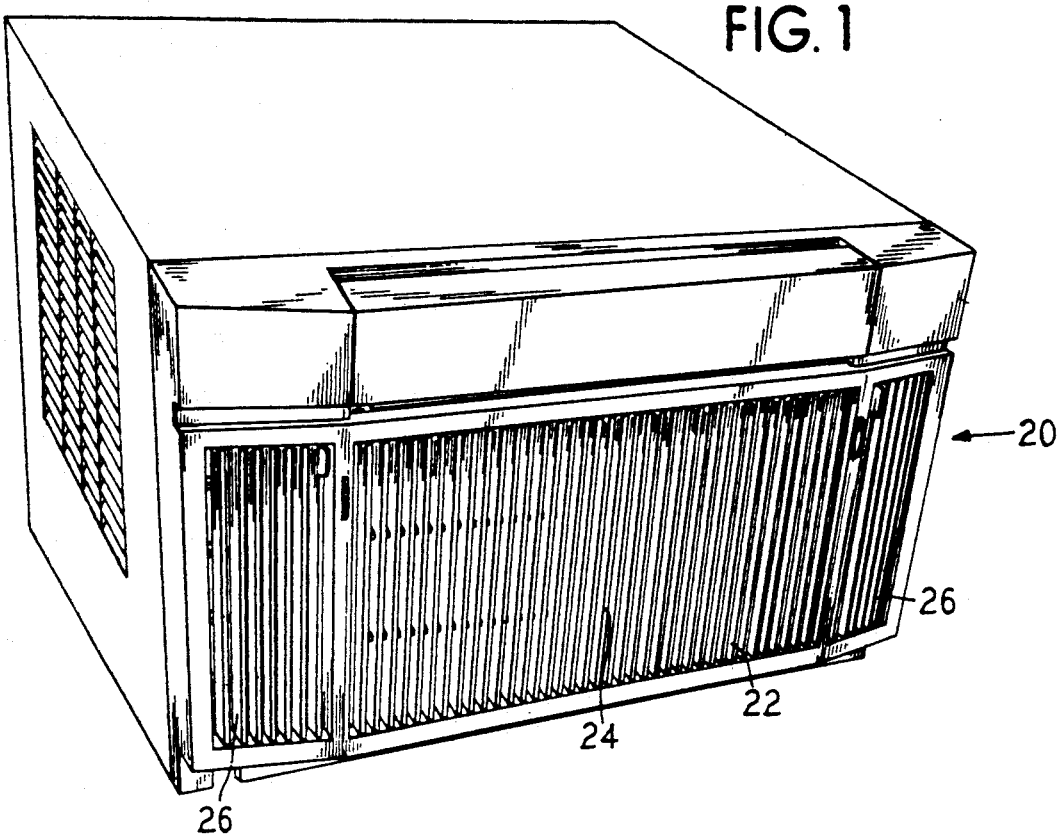
FIG. 1 is a perspective view of a room air conditioner embodying the principles of the present invention
Figure 2:
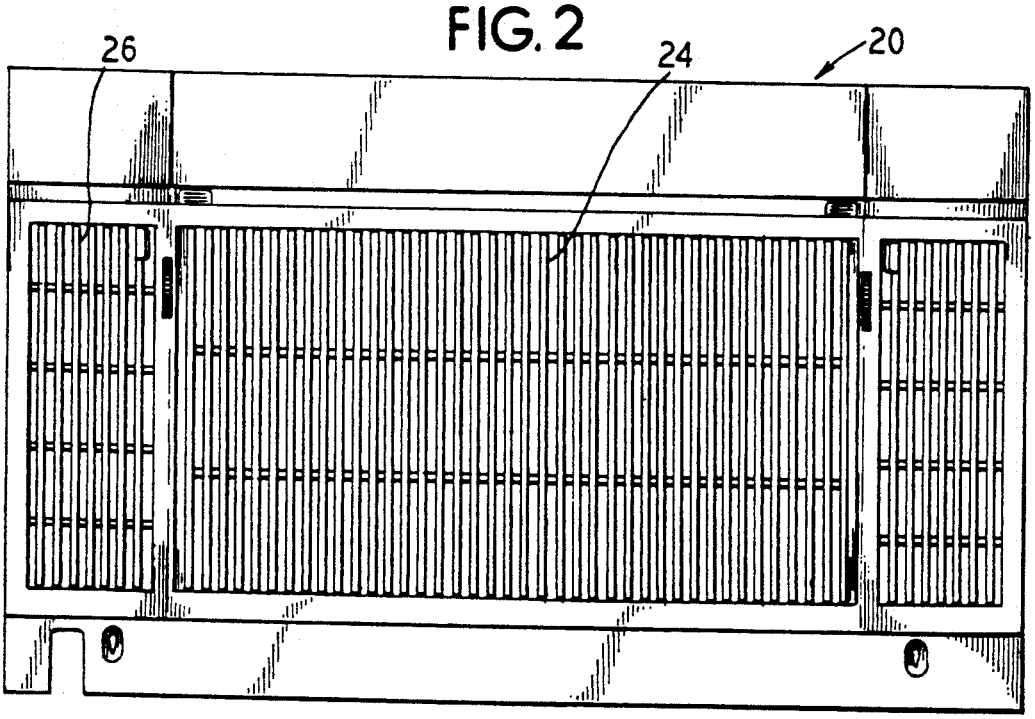
FIG. 2 is a front elevational view of the air conditioner of FIG. 1.

FIGS. 1 and 2 illustrate an air conditioner generally at 20 which embodies the principles of the present invention. Such an air conditioner is described in detail in co-pending application Ser. Nos. 522,179 and 522,199 and U.S. Pat. No. 5,046,406, all of which are incorporated herein by reference. The air conditioner has a front panel 22 which faces the interior of a room to be cooled when the air conditioner unit is placed in an open window or in a through-the-wall sleeve. A central portion 24 of the panel constitutes an air inlet grill through which air flows into a portion of the air conditioning unit. The air is returned to the room through a pair of laterally spaced outlet adjustable louver assemblies 26. The assemblies 26 are independently controllable by the user and contain louvers that are pivotable about both a vertical axis and horizontal axis giving the user a wide range of air flow configurations as described in greater detail below.

Figure 3:
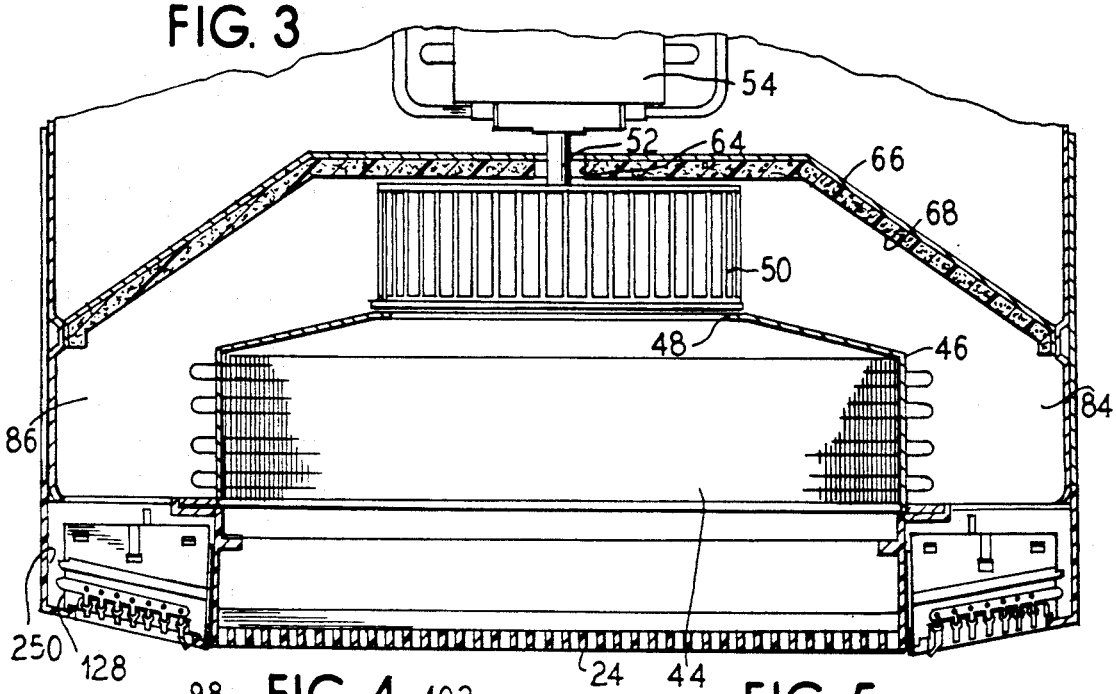
FIG. 3 is a top sectional view of the air conditioner of FIG. 1.
Figure 4:
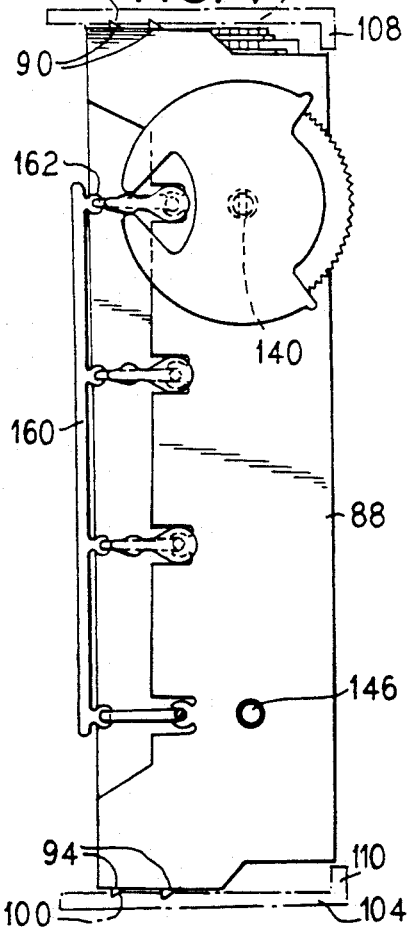
FIG. 4 is a side view of the adjustable louver assembly of FIG. 1.
Figure 5:
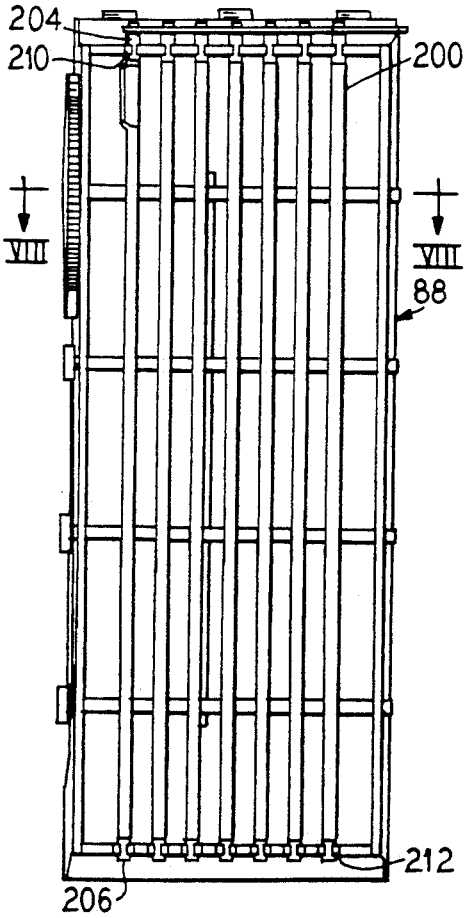
FIG. 5 is a front elevational view of the adjustable louver assembly shown in FIG. 1.
Figure 6:
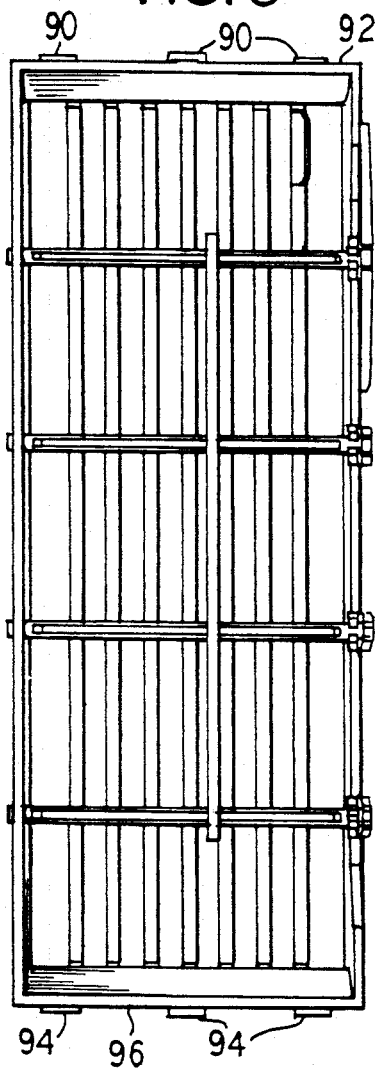
FIG. 6 is a rear elevational view of the adjustable louver assembly.
Figure 7:
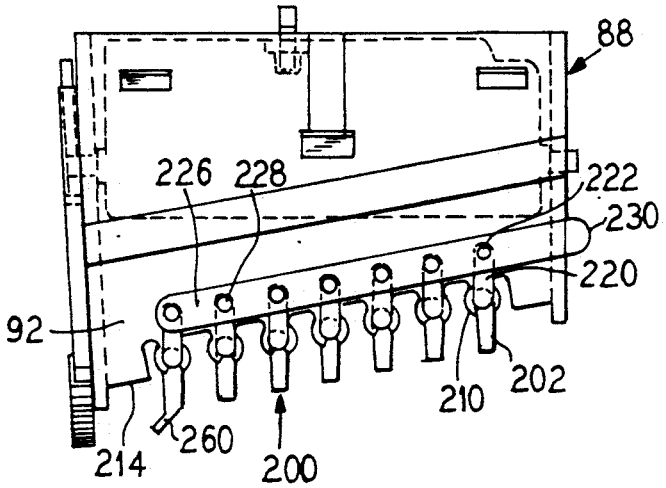
FIG. 7 is a top elevational view of the adjustable louver assembly.
Figure 8:
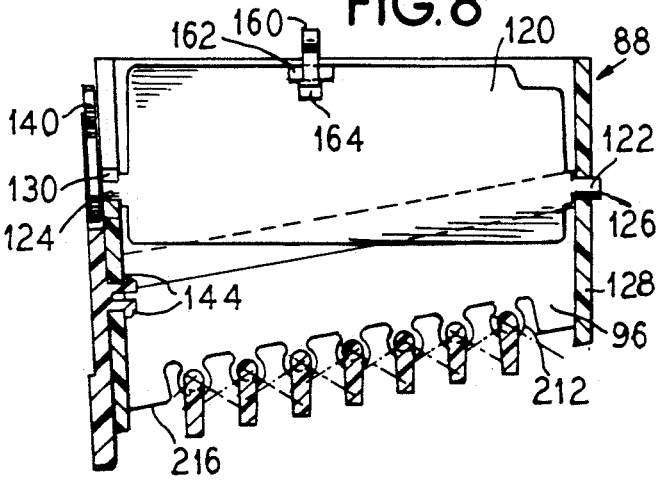
FIG. 8 is a sectional view of the adjustable louver assembly taken generally along the line VIII—VIII of FIG. 5.
Figure 9:
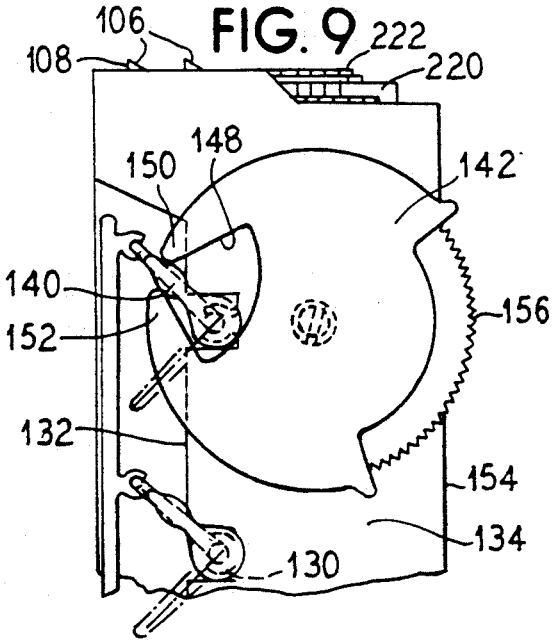
FIG. 9 is a partial side view of the adjustable louver assembly showing the horizontal louver control device.

Some of the internal components of the air conditioner are shown in greater detail in FIG. 3 and in this view the symmetrical nature of the air conditioner construction and symmetrical nature of the air flow is quite evident. Directly behind the front inlet grill 24 is located an evaporator 44 which is mounted within a sheet metal housing 46. The housing 46 has a central rear opening 48 which is positioned directly in front of an air moving device, preferably a blower wheel 50. The blower wheel 50 is mounted on a forwardly extending drive shaft 52 of a electric motor 54. The drive shaft 52 extends along the center line of the air conditioner. A compressor and condenser are provided as is known in the art.

The forwardly extending drive shaft 52 extends through an opening 64 in a barrier wall 66 provided between the blower wheel 50 and the motor 52. The barrier wall 66 separates the cold side of the air conditioner (forward of the wall) from the hot side (rearward of the wall). This is desireable to prevent air which has been chilled by passing through the evaporator 44 from being inadvertently discharged through the rear of the air conditioner and to prevent hot air in the condenser portion of the air conditioner from being inadvertently drawn into the cold portion of the air conditioner. A barrier of expanded polystyrene 68 is provided along the barrier wall 66 which provides an insulation against heat transfer.

Positioned at the front of the air conditioner in an outlet of each of air ducts 84, 86 is the adjustable louver assembly 26 which is shown in greater detail in FIGS. 4–9. Each assembly 26 comprises a box-like housing member 88 having vertically upwardly projecting pins 90 at a top wall 92 and vertically downwardly projecting pins 94 at a bottom wall 96. The pins 90, 94 are seated into recesses 98, 100 in a top wall 102 and a bottom wall 104 of the air conditioner housing (see FIG. 4) to hold the housing member 88 fixed and immobile relative to the air conditioner housing. The pins 90, 94 have an angled front face 106 and a substantially vertical rear face 108, thus facilitating assembly of the housing member 88 into the front panel 22 of the air conditioner from a rear side of the front panel. The housing member thus cannot easily be pressed rearwardly to disengage it from the front panel. The top and bottom walls 102, 104 of the front panel have vertical lips 108, 110 thereon which prevent the housing member 88 from being removed through the front of the panel 22.

The horizontal louvers each comprise a plate-like portion 120 which is received within the interior of the housing member 88. Each plate-like member 120 has a pin or axle 122, 124 projecting from each lateral side thereof, with the two axles 122, 124 being in alignment. The first axle 122 is received in a circular opening 126 in a sidewall 128 of the housing 88. The other axle 124 is received in a snap yoke 130 formed at an edge 132 of an opposite sidewall 134 of the housing member 88. Thus, the horizontal louver members are easily assembled into the housing member 88 by introduction of the first axle 122 and in the opening 126, pivoting of the horizontal louver until axle 124 hits the snapped yoke 130 and then snapping the axle into the yoke. The horizontal member is then securely retained in place, yet is free to pivot within the restraints of the housing.

The second axle 124 has a finger 140 formed on a free end thereof, which finger is oriented perpendicular to a rotational axis of the axle 124. An actuator wheel 142 is provided which has a pair of resilient projections 144 positioned at a center point of the wheel and which project parallel to an axis of the circular wheel. The projections 144 are configured so as to snap into an aperture 146 in the sidewall 134 of the housing member 88. The actuator wheel 142 has a shaped recess 148 which receives the finger 140 of the horizontal louver. The recess 148 in the actuator wheel 142 defines two opposed arms 150, 152 which are spaced apart in an amount slightly in excess of the width of the finger which projects therebetween. As the actuator wheel 142 is rotated by means of the projections being captured within the aperture 146 in sidewall 134, one or the other of the arms 150, 152 (depending upon the direction of rotation of the actuator wheel 142) engages the finger 140 and causes the horizontal louver to pivot. The actuator wheel 142 has a diameter sized such that a portion of the peripheral edge of the wheel projects beyond a front edge 154 of the sidewall 134 and the projecting portion is serrated as at 156 to provide a frictionally enhanced manual engagement surface for a user to operate the wheel.

As the wheel is rotated, the horizontal louver whose finger is engaged is caused to pivot about its horizontal axis, thus changing the angle of inclination of the horizontal louver. The size and shape of the recess 148 determines the angle or range of pivoting movement of the horizontal louver.

A connecting bar 160 extends between each of the horizontal louvers and a snap yoke 162 projecting from the connecting bar securely engages a cylindrical segment 162 formed on the horizontal louver adjacent to an aperture 164. The aperture 164 provides clearance for the yoke, thus permitting a pivoting action between the connecting bar 160 and the horizontal louver. By this means, each of the horizontal louvers is connected to the next and thus the pivoting of one horizontal louver by means of the actuator wheel causes a simultaneous pivoting action of all 10 of the horizontal louvers since they are linked in tandem.

Each vertical louver member 200 is comprised of a plate-like member 202 which extends substantially the entire height of th housing member 88. Projecting from each end of the vertical louver 200 is an axle 204, 206. The housing member 88 has a series of snap yokes 210, 212 formed along a forward edge 214, 216 of the top 92 and bottom 96 walls of the housing member 88. The axles 204, 206 are received in the snap yokes 210, 212 such that the vertical louver members 200 are securely, yet pivotally captured in the housing. Each of the first axles 204 has a crank arm 220 formed thereon with an upstanding pin 222 projecting from the crank arm 220 parallel to said axle, yet laterally displaced therefrom. A connecting link 226 has a series of circular aperture 228 therein which receive the pins 222, thus linking all of the vertical louver members 200 so that they will pivot in tandem. The link member 226 has an end 230 which projects beyond an outside wall 128 of the housing member to engage with a sidewall 250 of the front panel 22 so that the vertical louvers are not directed in a manner which would cause the air to be directed to an area directly in front of the air conditioner which would cause a short circuiting of the air flow from the air outlet to the air inlet.

At least one of the vertical louvers has a forwardly extending tab 260 which facilitates the manual grasping and moving of that one vertical louver member. Since each of the vertical louver members is linked to the next, all of the vertical louvers will thus move in tandem.

At least one of the sets of vertical louvers or horizontal louvers is mounted such that its range of pivotal movement and spacing between adjacent louvers permits such louvers to be fully pivoted until adjacent louvers lie on top of one another to essentially form a solid wall. For example, such an arrangement is illustrated in phantom lines in FIG. 8 wherein the vertical louvers 202 are free to move through a range whereby adjacent louvers will lie on top of one another. Of course the width and spacing of the louvers must be arranged and selected so as to permit an overlapping of adjacent louvers.

Thus, it is seen that the present invention provides a louver assembly for an air conditioner which can be used to selectively direct exiting air in both a horizontal and vertical sense. The entire louver assembly can be assembled without the use of additional fasteners. Common louvers move in tandem and means are provided to prevent the louvers from being positioned such that a short circuiting of cooled air is directed back towards the inlet of the air conditioner.

At least one of the sets of vertical louvers can be completely closed such that, in the embodiment illustrated in the drawings, a higher volume of cooled air will be ejected from the remaining open louver assembly at a higher force thus causing the cooled air to be directed further into the room than arrangements wherein the air flow is split between a greater number of outlets, or a larger outlet opening.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An adjustable louver assembly for a room air conditioner comprising:

a box-like housing having an upstream inlet side and a downstream outlet side;

a plurality of parallel first louver members, said first louver members each comprising a plate-like portion received in an interior of said housing and having a first and second axle projecting from two opposite lateral sides thereof, said second axle, said first louver members having connection means such that all of said first louver members will pivot in tandem having a finger formed on a free end thereof, said finger being oriented perpendicular to a rotational axis of said second axle;

a plurality of parallel second louver members individually pivotally mounted in said housing, perpendicular to said first louver members and downstream of said first louver members, said second louver members having connection means such that all of said second louver members will pivot in tandem; and an actuator member rotatably mounted relative to a sidewall of said housing and having a recess for receiving said finger, said recess defined by two opposed arms spaced apart slightly in excess of a thickness of said finger, such that as said actuator is rotated, one of said arms engages said finger and causes said first louver members to pivot.

2. An adjustable louver assembly according to claim 1, wherein said actuator member is mounted on said sidewall.

3. An adjustable louver assembly according to claim 1, wherein all of one of said first louver members and second louver members are sized, spaced and pivotally mounted so that said louver members can be pivoted to a fully closed position with adjacent louver members overlapping and in engagement with one another to produce a substantially solid wall.

4. An adjustable louver assembly according to claim 1, wherein said first louver members connecting means is a link member pivotally connected to said first louver members.

5. An adjustable louver assembly according to claim 1, wherein said second louver members connecting means is a link member pivotally connected to said second louver members.

6. An air conditioner comprising:

an air inlet;

means for cooling air;

an air outlet;

means for moving air in a flow path from said air inlet, past said means for cooling air and to said air outlet.

an adjustable louver means positioned in said air outlet for directing air flowing out of said outlet comprising:

a box-like housing having an upstream inlet side and downstream outlet side;

a plurality of parallel first louver members, said first louver members each comprising a plate-like portion received in an interior of said housing and having a first and second axle projecting from two opposite lateral sides thereof, said second axle having a finger formed on a free end thereof, said finger being oriented perpendicular to a rotational axis of said second axle, said first louver members having connection means such that all of said first louver members will pivot in tandem a plurality of parallel second louver members individually pivotally mounted in said housing, perpendicular to said first louver members and downstream of said first louver members, said second louver members having connection means such that all of said second louver members will pivot in tandem; and an actuator member rotatably mounted relative to a sidewall of said housing and having a recess for receiving said finger, said recess defined by two opposed arms spaced apart slightly in excess of a thickness of said finger, such that as said actuator is rotated, one of said arms engages said finger and causes said first louver members to pivot.

7. An air conditioner according to claim 6, wherein said actuator member is mounted on said sidewall.

8. An air conditioner according to claim 6, wherein all of one of said first louver members and second louver members are sized, spaced and pivotally mounted so that said louver members can be pivoted to a fully closed position with adjacent louver members overlapping and in engagement with one another to produce a substantially solid wall.

9. An air conditioner according to claim 6, wherein said first louver members connecting means is a link member pivotally connected to said first louver members.

10. An air conditioner according to claim 6, wherein said second louver members connecting means is a link member pivotally connected to said second louver members comprising a link member for connecting said second louver members.

11. An air conditioner according to claim 6, wherein said box-like housing is mounted in a fixed, immobile position relative to said air outlet.

* * * * *